US006971128B1

(12) United States Patent
McGrath

(10) Patent No.: US 6,971,128 B1
(45) Date of Patent: Dec. 6, 2005

(54) SIZE-CONVERTIBLE PILLOW CASE OR DUVET COVER

(75) Inventor: Tara McGrath, New York, NY (US)

(73) Assignee: CHF Industries, Inc., New York, NY (US)

( * ) Notice: Subject to any disclaimer, the term of this patent is extended or adjusted under 35 U.S.C. 154(b) by 0 days.

(21) Appl. No.: 10/710,714

(22) Filed: Jul. 29, 2004

(51) Int. Cl.[7] ..... A47G 9/10
(52) U.S. Cl. ..... 5/490; 5/485; 5/482
(58) Field of Search ..... 5/482, 485, 490, 5/501

(56) References Cited

U.S. PATENT DOCUMENTS

| | | | | |
|---|---|---|---|---|
| 834,643 | A * | 10/1906 | Schnadig | 5/484 |
| 1,775,061 | A * | 9/1930 | Bertha | 5/490 |
| 2,357,789 | A * | 9/1944 | Levy | 5/490 |
| 2,782,840 | A | 2/1957 | Armbrecht | |
| 2,883,682 | A | 4/1959 | Kwake | |
| 2,952,856 | A | 9/1960 | Ruff | |
| 3,267,496 | A * | 8/1966 | Gionet | 5/490 |
| 3,974,531 | A * | 8/1976 | Van Pelt | 5/490 |
| D270,320 | S | 8/1983 | Smith | |
| 4,651,371 | A | 3/1987 | Hahn | |
| 5,084,928 | A | 2/1992 | Skillington | |
| D336,201 | S | 6/1993 | Rogers | |
| D356,711 | S | 3/1995 | Farrell | |
| 5,430,902 | A | 7/1995 | Lewis | |
| D409,872 | S | 5/1999 | Rodgers | |
| D418,709 | S | 1/2000 | Stewart | |
| D430,768 | S | 9/2000 | Hindes | |
| 6,427,268 | B1 | 8/2002 | Davis | |
| D471,751 | S | 3/2003 | Chihlas | |

* cited by examiner

*Primary Examiner*—Michael Trettel
(74) *Attorney, Agent, or Firm*—Connolly Bove Lodge & Hutz LLP

(57) ABSTRACT

A pillow case or cover converts from a first size to accommodate a pillow with a longer length, such as a king-sized pillow, to a second size to accommodate a pillow with a shorter length, such as a queen-sized pillow. In the larger pillow configuration, a flap adjacent to the open end of the case holds one end of the pillow and a fastener on the flap, such as a button, mates with a hole through the front face of the cover. In a smaller pillow configuration, the flap and a portion of the front and rear faces of the pillow cover are folded and inserted into the interior of the cover, and a different fastener on the rear face of the cover, such as a button, engages a mating fastener, such as a loop, that is appended to the front face of the pillow cover to secure the open end and encase the shortened cover over the smaller pillow. The pillow case or cover may be reversibly converted from the first configuration to the second configuration and back again. A convertible duvet cover that functions in the same way is also disclosed.

19 Claims, 3 Drawing Sheets

SIZE-CONVERTIBLE PILLOW CASE OR DUVET COVER

FIELD OF THE INVENTION

The present invention relates in a first aspect to pillow cases specially adapted for use with pillows of varying size, such as queen-size and king-size, that can be converted from a first size to a second size by varying folded configuration without adding or taking away fabric material. The present invention relates in a second aspect to duvet covers specially adapted for use with duvets of varying size that can be converted from a first size to a second size by folding without adding or taking away fabric material.

BACKGROUND OF THE INVENTION

Bed pillows are sold in various sizes commonly referred to as standard, queen, king and California-king sizes. Byway of example, standard-sized pillows and queen-sized pillows have a width of about 20 inches and a length of about 30 inches, whereas king-sized pillows have a width of about 20 inches and a length of about 36 inches. California-king pillow cases may have a longer length. Consumers currently purchase pillow cases of a certain size to fit one pillow size, and must purchase separate pillow cases of different sizes to fit over different-sized pillows. Alternatively, consumers purchase a larger-sized pillow case, and tolerate an improper fit when placing such larger size case over a smaller pillow.

Various pillow case constructions have been shown in the art. See, e.g., U.S. Pat. Nos. 1,775,061; 5,430,902; Des. 409,872 and Des. 430,768. None of the prior patents has disclosed a pillow case that may be converted from a first size to accommodate a pillow with a longer length to a second size to accommodate a pillow with a shorter length without sewing and without cutting or removing material from the pillow case.

Therefore, there is a need in the art to provide convertible pillow cases that will encase multiple sizes of pillows.

Similarly, there is a need in the art to provide convertible duvet covers that will encase multiple sizes of duvets.

SUMMARY OF THE INVENTION

One exemplary embodiment of the present invention is a size-convertible pillow case or cover that defines an internal portion for receiving a pillow and an external portion having a front face and a rear face. The pillow cover defines an open end communicating with the internal portion. The front face of the pillow cover defines at least one opening therethrough, such as a button hole. The pillow cover further includes a flap portion at the open end, wherein the flap portion forms a pouch within the internal portion of the pillow cover. The flap portion defines a front face and a rear face. At least one fastener, such as a button, is attached to the front face of the flap portion, wherein said fastener is engagable with the at least one opening through the front face of the pillow cover to secure the pillowcase over a pillow of a first size, such as a king-sized pillow, when such king-sized pillow is received within the pillow cover.

Preferably, there are multiple fasteners attached to the flap, and multiple mating openings through the front face of the pillow cover. When a pillow of larger size, such as a king-sized pillow, is held within the pillow cover, the end portion of the pillow is held within the flap, and the fasteners mate with the openings (such as a button mating with a button hole) to secure the pillow cover over the pillow.

Optionally, the front face of the pillow cover may be provided with one or more loops that may further engage the button(s) to provide a more secure and more decorative closing means. Most preferably, a tape or decorative ribbon is applied around the pillow cover over the front and rear faces, and the loops are engaged to the tape. In this other embodiment, the tape is spaced apart from the open end of the pillow cover at a distance substantially equal to the length of the flap.

To convert the pillow cover to accommodate a pillow of a smaller size or shorter length, such as a standard-sized pillow, the king-sized pillow is removed and a standard-sized pillow is inserted into the cover. Then, the flap and a portion of the front and rear faces of the pillow cover are folded and inserted into the interior of the pillow cover. By so folding and inserting, a new open end of the pillow cover is defined, and the pillow cover has a new length that is shorter than the first length. Preferably, the flap is folded so as to cover one end of the pillow. The loop(s) are then fastened over fastener(s) applied to the rear face of the pillow cover, such as buttons, to secure the pillow cover over the standard-sized pillow. Most preferably, the loops are engaged to the tape or decorative ribbon applied around the pillow cover over the front and rear faces of the pillow cover. The tape thus helps to define the new open end of the pillow cover.

The pillow cover may be reversibly altered from its first, longer-length size to accommodate a king-sized pillow to a second, shorter-length size to accommodate a standard-sized pillow and back again: (1) by folding and inserting the flap and a portion of the front and rear faces into the interior of the pillow cover, or (2) unfolding and removing the inserted flap and other folded portions from the interior of the pillow cover. In addition, the pillow case or cover may be formed of various size-convertible configurations. For example, its longer length may be adapted to accommodate a queen-sized pillow and the flap may have a length so that the cover may be shortened to a length to accommodate a standard-sized pillow. Many size variations to accommodate California king, king, queen, standard and twin sized pillows are within the scope of the invention.

A further exemplary embodiment is a convertible duvet cover. The convertible duvet cover has a structure comparable to the pillow cover, but the size of the cover is formed to fit over duvets, rather than over pillows. Hence, the duvet cover functions in the same manner as the pillow cover. That is, the duvet cover defines an internal portion for receiving a duvet and an external portion having a front face and a rear face. The duvet cover defines an open end communicating with the internal portion. The front face of the duvet cover defines at least one opening therethrough, such as a button hole. The duvet cover further includes a flap portion at the open end, wherein the flap portion forms a pouch within the internal portion of the duvet cover. The flap portion defines a front face and a rear face. At least one fastener, such as a button, is attached to the front face of the flap portion, wherein said fastener is engagable with the at least one opening through the front face of the duvet cover to secure the cover over a duvet of a first size, such as a queen-sized duvet or comforter, when such queen-sized duvet is received within the duvet cover.

Preferably, there are multiple fasteners attached to the flap, and multiple mating openings through the front face of the duvet cover. When a duvet of larger size, such as a queen-sized duvet, is held within the cover, the end portion of the duvet is held within the flap, and the fasteners mate with the openings (such as a button mating with a button hole) to secure the cover over the duvet.

The duvet cover may be reversibly altered from its first, longer-width size to accommodate a queen-sized duvet or comforter to a second, shorter-width size to accommodate a standard-sized or even twin-sized duvet and back again: (1) by folding and inserting the flap and a portion of the front and rear faces into the interior of the cover, or (2) unfolding and removing the inserted flap and other folded portions from the interior of the cover. In addition, the duvet cover may be formed of various size-convertible configurations.

DETAILED DESCRIPTION OF THE INVENTION

Figure 1:
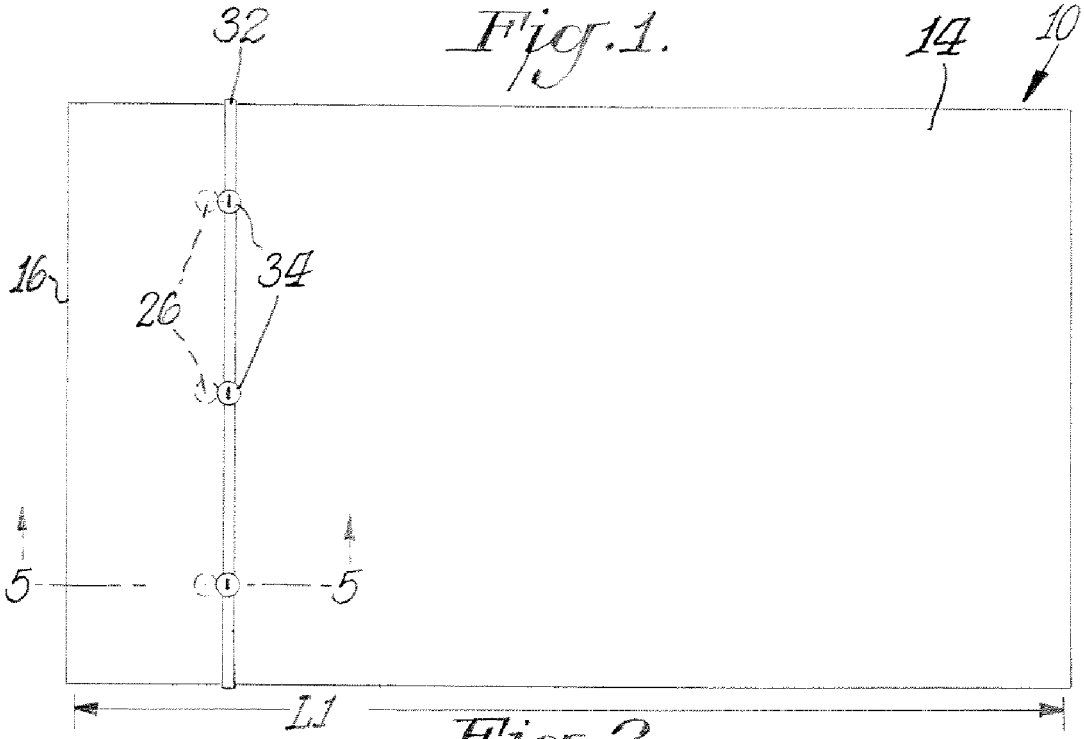
FIG. 1 is a bottom plan view of a convertible pillow case or cover of the invention which is opened to receive either a queen-sized or king-sized bed pillow.
Figure 2:
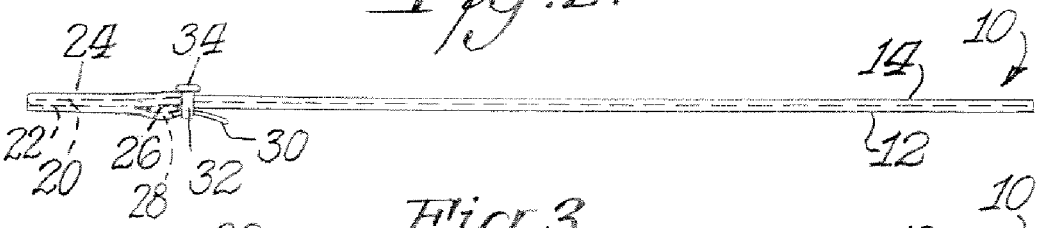
FIG. 2 is a side elevational view of the convertible pillow cover of FIG. 1.
Figure 3:
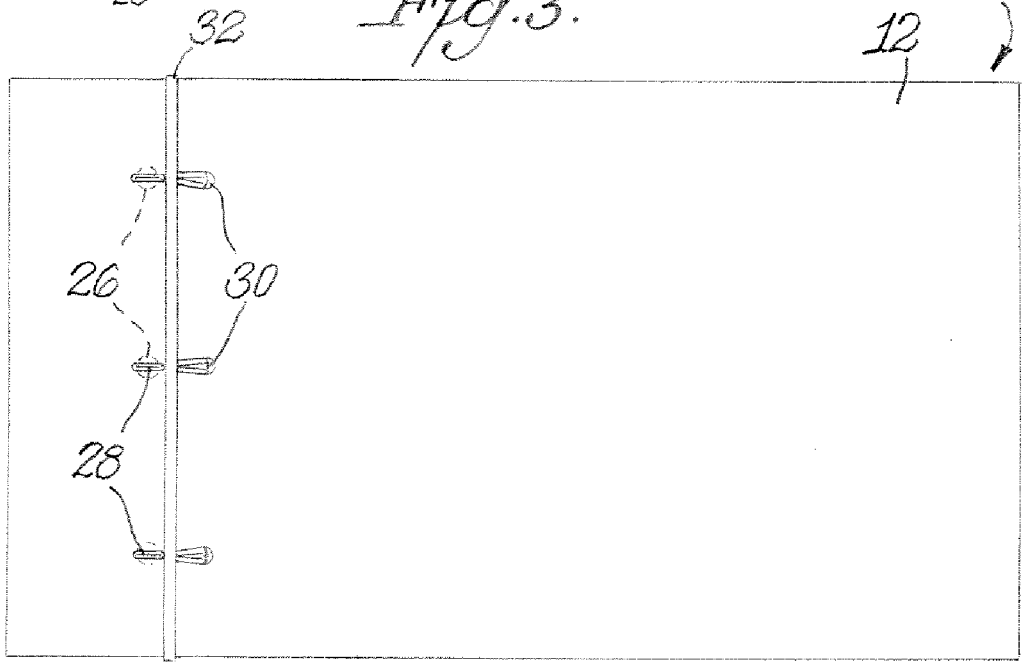
FIG. 3 is top plan view of the convertible pillow cover of FIG. 1.
Figure 4:
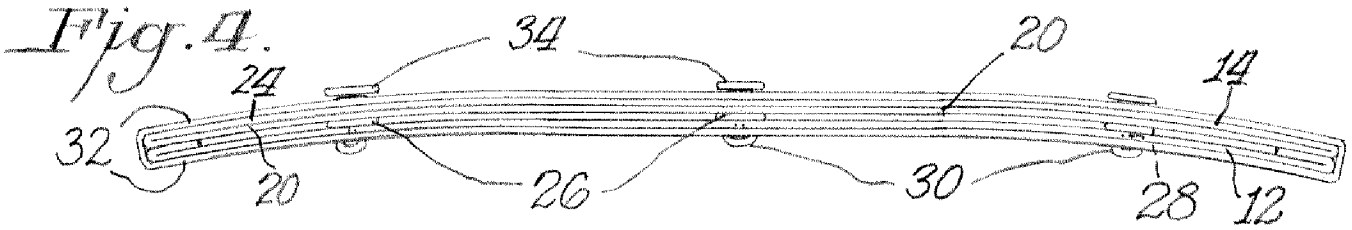
FIG. 4 is an enlarged end elevational view of the convertible pillow cover of FIG. 1.

Referring first to FIGS. 1 to 3, a convertible pillow case or cover 10 according to a first embodiment of the invention has an external portion with a front face 12 and a rear face 14. The pillow cover 10 defines an open end 16 into which a pillow of a first size is inserted into the cover. As shown in FIGS. 1–3, the pillow cover 10 is configured to receive a larger-sized pillow having a length L1, such as a king-sized pillow.

A flap 20 is formed at the open end 16 of the pillow cover 10. The flap 20 defines a front face 22 and a rear face 24. Three buttons 26 are attached to the front face 22 of the flap 20 in spaced apart relation. While regular round buttons have been illustrated in FIG. 2, buttons and button-like fasteners of other configuration may be used. Moreover, alternate fasteners may be used, such as, but not limited to, hook and eye fasteners or string ties.

Three button holes 28 are formed through the front face 12 of the pillow cover 10. The button holes 28 are spaced apart and configured so as to engage buttons 26 attached to the flap 20. As shown best in FIG. 7, after the pillow 40 is inserted into the pillow case or cover 10, one end of the pillow 40 fits within the flap 20. The buttons 26 then are mated with the button holes 28 to secure the pillow cover 10 over the pillow 40. In this configuration (shown in FIGS. 6 and 7), the pillow cover has a length L1 that is long enough to accommodate a pillow of a larger size and longer length, such as a king-sized bed pillow.

Figure 7:
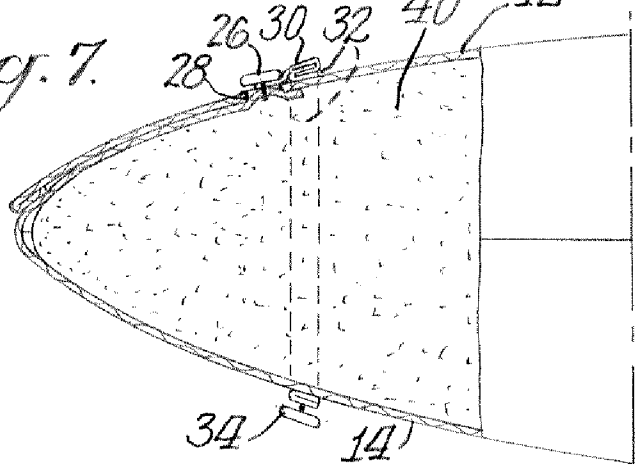
FIG. 7 is a fragmental cross-sectional view in side elevation taken along line 7—7 of FIG. 6.
Figure 6:
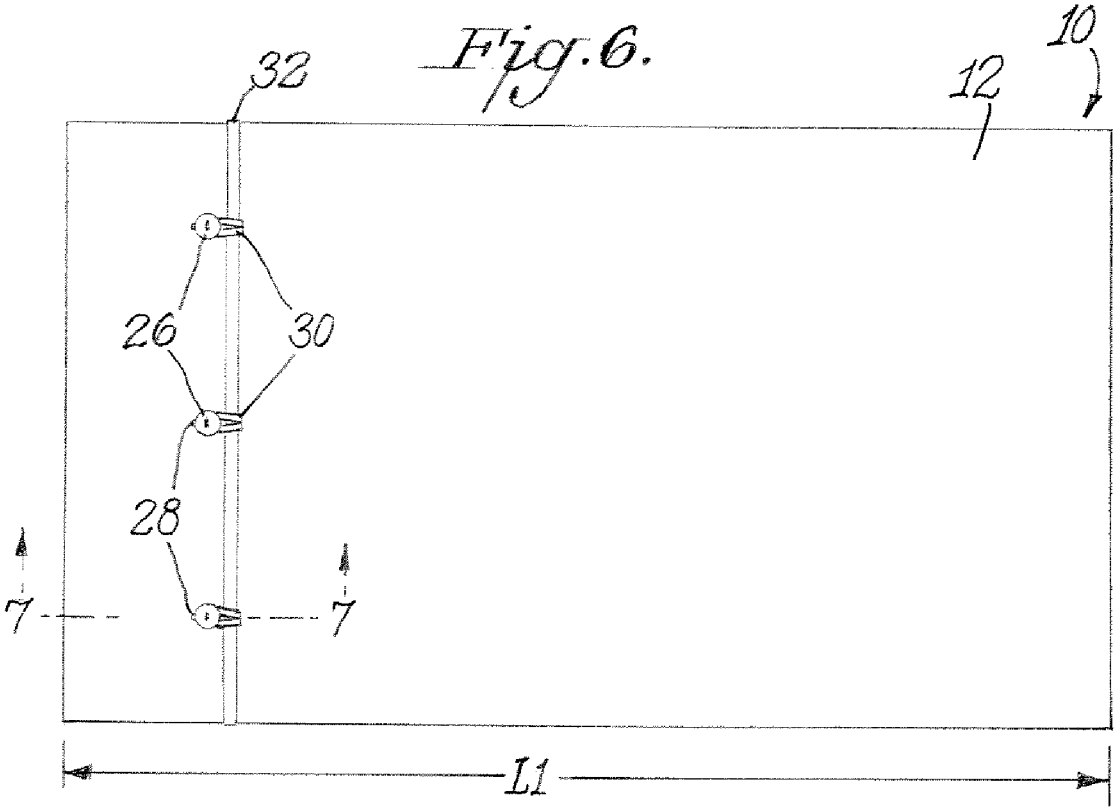
FIG. 6 is a top plan view of the convertible pillow cover with closure means engaged and having a pillow with a length L1 (such as a king-sized pillow) encased therein.

Optionally, loops 30 may be attached to the front face 12 of the pillow cover 10. As shown in FIGS. 6 and 7, after the buttons 26 are mated with button holes 28, the loops 30 may be fastened over the buttons 26 to provide a second fastening connection. In this configuration, the loops 30 add to the decorative external appearance of the pillow cover 10.

Most preferably, a tape or decorative ribbon 32 is applied to the front and rear faces 12, 14 of the pillow cover 10. As shown in FIGS. 1 and 3, the tape 32 is attached around the external surface of the pillow cover 10 at a distance from the open end 16 of the pillow cover that is comparable to the length of the flap 20. In this preferred embodiment, the flap 20 length is substantially equal to the distance from the open end 16 of the pillow cover to the position of the tape 32.

While the pillow cover 10 of this embodiment has been shown with three buttons 26 on the flap 20 that mate with three button holes 28 through the front face 12 of the pillow cover 10, the pillow cover or duvet cover of the invention may be formed with fewer or more fasteners and companion mating holes. Such style variations are embraced within the scope of this invention.

In the preferred embodiment, three buttons 34 are attached to the rear face 14 of the pillow cover 10 as shown in FIG. 1. Most preferably, the buttons 34 are attached to the tape 32, if a decorative tape 32 has been applied. Buttons 34 are intended to engage loops 30 when the pillow cover 10 is disposed in its second configuration discussed in greater detail below. As illustrated in FIG. 1, the buttons 34 are provided in spaced apart relation with spacing comparable to that of buttons 26 attached to the flap 20. While the pillow cover 10 of this most preferred embodiment has been shown with three buttons 34 attached to the tape 32, the pillow cover of the invention may be formed with fewer or more fasteners and companion mating loops. Such style variations are embraced within the scope of this invention.

Figure 9:
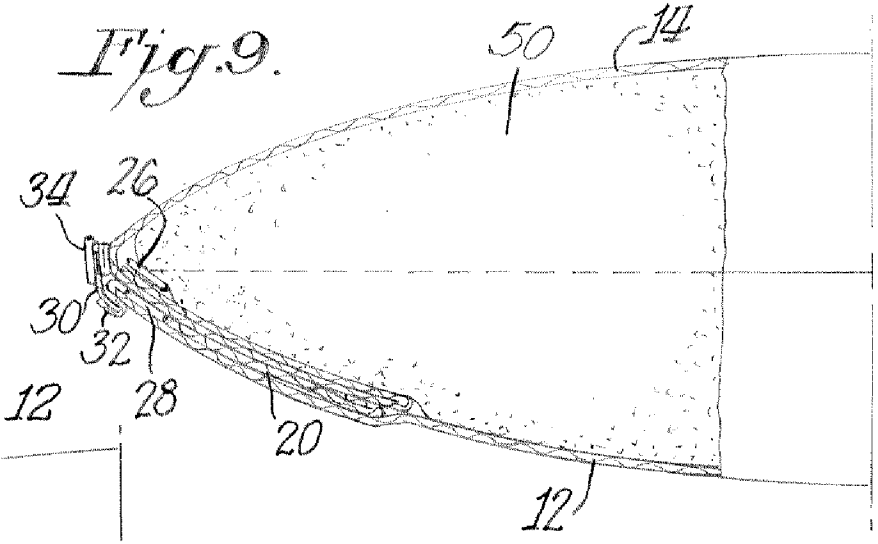
FIG. 9 is a fragmental cross-sectional view in side elevation taken along line 9—9 of FIG. 8.
Figure 5:
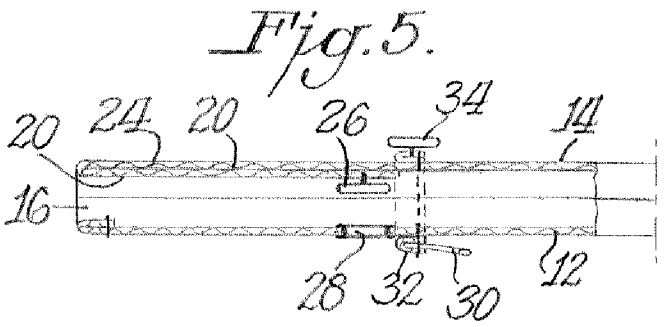
FIG. 5 is a fragmental cross-sectional view in side elevation taken along line 5—5 of FIG. 1.
Figure 8:
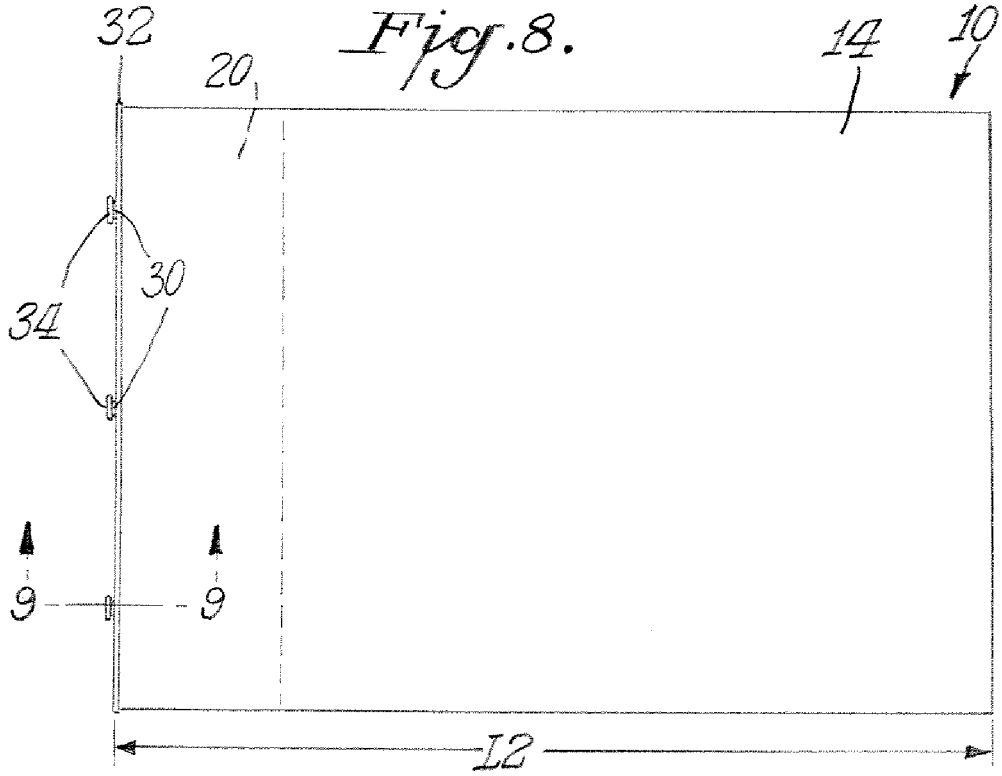
FIG. 8 is a top plan view of the convertible pillow cover with closure means engaged and having a pillow with a length L2 (such as a standard-sized pillow) enclosed therein.

In a second configuration illustrated best in FIGS. 8 and 9, the pillow cover 10 of the invention may be converted from a case or cover with a length L1 to a shorter length L2 to accommodate a pillow 50 of a smaller size or shorter length, such as a queen-sized pillow. After the larger sized pillow has been removed from the pillow cover, the pillow cover may be converted to its smaller size.

To convert the pillow cover 10, the flap 20 and a portion of the front and rear surfaces of the external portion of the pillow cover are folded and inserted into the internal portion of the pillow cover 10 as shown in FIG. 9. The pillow 50 may be inserted into the interior of the pillow case or cover either before or after the flap 20 has been folded. Preferably, as shown in FIG. 9, one end of the pillow fits within the flap 20, although it is possible also to fold the flap 20 so that the front face 22 of the flap 20 contacts the internal surface of the pillow cover 10.

With the shorter-length pillow 50 so encased within the pillow cover 10, the loops 30 may be fastened over buttons 34 to secure the pillow 50 within the pillow cover 10. In this manner, the pillow cover 10 has a length L2 (FIG. 8) that is shorter than the length L1 of the pillow cover 10 when it was in the first configuration (FIG. 6).

The pillow cover 10 may be reversibly converted from a cover or case with a length L2 to a length L1 by unfastening the loops 30 from buttons 34 and removing the pillow 50, extracting the flap 20 and other portions of the front and rear surfaces of the external portion from the interior of the pillow cover, inserting longer-length pillow 40 into the pillow cover, and re-engaging the buttons 26 with the button holes 28.

A size-convertible duvet cover according to the invention has the same structure as the pillow cover 10, but the length and width are longer as customarily for covering a duvet. In addition, in view of the longer length of the open end, a larger number of fasteners may be disposed on the duvet cover than would typically be used with a convertible pillow case.

Preferably, textile fabrics customarily used for pillow case constructions and duvet cover constructions are used to form the pillow cover 10 or duvet cover. One such fabric is cotton, such as a 300 thread count or lesser thread count cotton.

Though the invention has been described in terms of preferred embodiments, it will be obvious that the same may be varied in many ways. Such variations are not to be regarded as a departure from the spirit and scope of the invention and all such modifications, as would be obvious to one skilled in the art, are intended to be included within the scope of the following claims.

What is claimed is:

1. A size-convertible pillow or duvet cover, comprising:

a cover defining an internal portion for receiving a pillow or duvet and an external portion having a front face and a rear face, wherein said faces define a first length, said cover further defining an open end communicating with said internal portion, and said front face defining at least one opening therethrough;

a flap portion folded within the internal portion at the open end of the cover and forming a pouch within the internal portion of the cover, said flap portion having a front face and a rear face and side edges, with each side edge joined to a respective side edge of the rear face of the cover so to form said pouch; and at least one fastener attached to the front face of the flap portion, wherein said fastener is engagable with the at least one opening through the front face of the cover to secure the cover over a pillow or a duvet having a length receivable within the cover.

2. The cover of claim 1, further comprising at least one loop attached to the front face of the external portion of the cover, wherein said loop engages the at least one fastener.

3. The cover of claim 1, wherein the fastener is a button.

4. The cover of claim 1, wherein the front face of the external portion of the cover defines a plurality of openings therethrough and wherein a plurality of fasteners are attached to the front face of the flap portion so that each fastener engages a mating opening.

5. The cover of claim 1, wherein the flap defines a length, and wherein the cover further comprises a tape applied around the external surface of the cover at a position spaced apart from the open end at a distance substantially equal to the length of the flap.

6. The cover of claim 5, further comprising at least one loop attached to the front face of the external portion of the cover at the tape, wherein said loop engages the at least one fastener.

7. The cover of claim 1, wherein the flap defines a length, and wherein the cover further comprises at least one other fastener attached to the rear face of the external portion of the cover at a distance from the open end substantially equal to the length of the flap, and wherein the cover further comprises at least one loop attached to the font face of the external portion of the cover, wherein the flap portion, and portions of the front and rear faces of the external portion are foldable and insertable into the internal portion of the cover to shorten the length of the front and rear faces.

8. The cover of claim 7, wherein the at least one other fastener attached to the rear face of the external portion of the cover is engageable with the at least one loop so that a different pillow or a different duvet having a length that is shorter than the first length may be received within the cover.

9. The cover of claim 7, wherein the at least one other fastener comprises a plurality of fasteners attached to the rear face of the external portion of the cover, and wherein the at least one loop comprises a plurality of loops, and further wherein each loop is engageable with a mating other fastener so that a different pillow or a different duvet having a length that is shorter than the first length may be received within the cover.

10. The cover of claim 7 wherein the at least one other fastener is a button.

11. The cover of claim 7, wherein the cover further comprises a tape applied around the external surface of the cover at a position spaced apart from the open end at a distance substantially equal to the length of the flap.

12. The cover of claim 11, wherein said at least one other loop is attached to the front face of the external portion of the cover at the tape.

13. The cover of claim 12, wherein the wherein the flap portion, and portions of the front and rear faces of the external portion are foldable and insertable into the internal portion of the cover so as to define a new open end of the cover at the tape.

14. The cover of claim 7, wherein the portion of the front face of the external portion of the cover that is inserted into the internal portion of the cover contacts the pillow or the duvet when the pillow or duvet is received within the cover.

15. The cover of claim 7, wherein the portion of the rear face of the external portion of the cover that is inserted into the internal portion of the cover contacts the pillow or the duvet when the pillow or duvet is received within the cover.

16. The cover of claim 7, wherein a portion of the pillow or duvet is held in the fold formed between the flap and the internal portion of the cover opposite the rear face when the pillow or duvet is received within the cover.

17. A method for converting a pillow case or duvet cover from a first size to accommodate a pillow or duvet with a first length to a second size to accommodate another pillow or another duvet with a second length shorter than said first length, comprising:

providing a cover defining an internal portion for receiving the pillow or duvet or the another pillow or another duvet, said cover further defining an external portion having a front face and a rear face, wherein said faces define a first length, said cover further defining an open end communicating with said internal portion, and said front face defining at least one opening therethrough;

folding a flap portion within the internal portion at the open end of the cover and forming a pouch within the internal portion of the cover, said flap portion having a front face and a rear face and having at least one fastener attached to the front face of said flap portion, so that upon folding the cover faces define a second length shorter than said first length;

inserting the another pillow or another duvet into the internal portion through the open end of the cover; and engaging said fastener with the at least one opening through the front face of the cover to secure the cover over the another pillow or duvet.

18. The method of claim 17, wherein the flap portion defines a length, and wherein the cover further comprises at least one other fastener attached to the rear face of the external portion of the cover at a distance from the open end substantially equal to the length of the flap, and wherein the cover further comprises at least one loop attached to the front face of the external portion of the cover, and wherein folding a flap portion comprises folding the flap portion and folding and inserting portions of the front and rear faces of the external portion into the internal portion of the cover to shorten the length of the front and rear faces.

19. A size-convertible pillow or duvet cover, comprising:

a cover defining an internal portion for receiving a pillow or duvet and an external portion having a front face and a rear face, wherein said faces define a first length, said cover further defining an open end communicating with said internal portion, and said front face defining at least one opening therethrough, wherein said front and rear faces further define a second length shorter than said first length when portions of said front and rear faces are folded into the internal portion at the open end of the cover;

a flap portion at the open end of the cover and having a front face and a rear face and a length, said flap portion forming an integral pouch defining a receiving space between the flap portion rear face and the cover rear face for receiving a portion of a pillow or a duvet of a length comparable to said first length of said front face and said rear face of said cover when said portions of said front and rear faces are not folded into the internal portion; and at least one fastener attached to the front face of the flap portion, wherein said fastener is engagable with the at least one opening through the front face of the cover to secure the cover over the pillow or the duvet having a first length receivable within the cover.

* * * * *